US005636612A

United States Patent [19]

Brucato

[11] Patent Number: 5,636,612

[45] Date of Patent: Jun. 10, 1997

[54] ADJUSTABLE AIR VELOCITY STACKS FOR TWO-STROKE FUEL INJECTED ENGINES

[76] Inventor: Anthony Brucato, 9795 Mockingbird Trail, Jupiter, Fla. 33478

[21] Appl. No.: 575,216

[22] Filed: Dec. 20, 1995

[51] Int. Cl.[6] ..... F02D 9/08

[52] U.S. Cl. ..... 123/337; 123/73 A

[58] Field of Search ..... 123/337, 336, 123/403, 73 A

[56] References Cited

U.S. PATENT DOCUMENTS

| | | | |
|---|---|---|---|
| 3,086,758 | 4/1963 | Greene . | |
| 3,822,058 | 7/1974 | Carter . | |
| 4,008,298 | 2/1977 | Quantz . | |
| 4,064,857 | 12/1977 | Williams . | |
| 4,066,720 | 1/1978 | Carter . | |
| 4,116,185 | 9/1978 | Mayer et al. . | |
| 4,123,479 | 10/1978 | Andreassen . | |
| 4,257,379 | 3/1981 | Hickling . | |
| 4,438,745 | 3/1984 | Watanabe | 123/337 |
| 4,872,424 | 10/1989 | Carnes . | |
| 4,981,115 | 1/1991 | Okassako et al. . | |
| 5,121,719 | 6/1992 | Okazaki et al. | 123/179.14 |
| 5,251,591 | 10/1993 | Corrin | 123/337 |
| 5,454,357 | 10/1995 | Elder | 123/337 |
| 5,517,963 | 5/1996 | Yoshida et al. | 123/336 |

FOREIGN PATENT DOCUMENTS

| | | |
|---|---|---|
| 5-10159 | 1/1993 | Japan . |

*Primary Examiner*—Marguerite McMahon
*Attorney, Agent, or Firm*—Head, Johnson & Kachigian

[57] ABSTRACT

Air adjustment to a multi-cylinder two-cycle fuel injected engine, such as marine outboard type, is accomplished by a slide throttling control valve in conjunction with an upstream air velocity stack of variable thickness spacers.

16 Claims, 9 Drawing Sheets

ADJUSTABLE AIR VELOCITY STACKS FOR TWO-STROKE FUEL INJECTED ENGINES

BACKGROUND OF THE INVENTION

This invention relates generally to an air throttle control apparatus for internal combustion engines. In particular, the apparatus is to provide variable and adjustable control over flow characteristics of air to a two-cycle fuel injected engine such as found common in high horsepower outboard marine engines.

Electronic fuel injected internal combustion engines have become quite common in multiple cylinder outboard motors for the creation of higher speeds, whether it be high performance fishing 'bass boat' types or for motorboat racing purposes. Typically, these engines are electronic fuel injected having a forward air intake horn and manifold for supplying air to each cylinder. Heretofore, the air is typically throttled by the use of a butterfly-type throttling valve in the air horn. This form of air throttling has been found to be unsatisfactory, in permitting even finer tuning of the engine to accomplish peak torque at specific rpm's. This is especially so in motorboat racing where it is highly desirable to be able to adjust the air flow for particular conditions that exist at the race sight and for racing situations, i.e., time trials versus the race heats.

Slide valves have been used in carburation for internal combustion engines as an alternative to butterfly valves, such as shown in U.S. Pat. No. 4,454,537. Such slide valves have not, however, been able to provide means to change the flow characteristics of the air to the internal combustion engine. Such air flow characteristics include velocity, quantity, and the shape of the air flow.

SUMMARY OF THE INVENTION

It is an object of this invention to provide an improved and regulated air flow system to internal combustion engines.

A further object of the invention is to provide an improved means for regulating the air flow characteristics to fuel injected two-cycle internal combustion engines.

A further object of the invention is to provide an air intake velocity stack that provides control over the air flow characteristics for two-stroke fuel injected engines.

A yet further object of the invention is to provide means for quickly and efficiently adjusting the air flow characteristics to fuel injected two-stroke internal combustion engines.

The present invention provides for an air throttle assembly for multiple cylinder two-cycle fuel injected engines which can be readily attached to existing air intake systems. The assembly includes a base housing formed of a connected upstream front plate and downstream rear plate. There are spaced transverse ports across the base housing for the passage of air downstream to each cylinder of the engine. On the downstream side of the rear plate, a reed valve cage is sealably attached covering each port. Reed valves are commonly used in such engines to provide timed intake to each cylinder.

A vacuum channel is formed in an upstream side of the rear plate which channel is in communication with each port. This channel is used to provide communication to appropriate electronic control means utilized in conjunction with engine and which are outside of the throttle assembly. The rear plate is mountably attached to the engine. Between the front and rear plate is a slidable throttle plate which acts as a valve to control the passage of air. This plate includes spaced openings to match each transverse port in a full open position and with web sections between the spaced openings to fully cover the ports in a fully closed position. Idle bleed holes for each port are found in the sections. Appropriate linkage is provided to slide the throttle plate to and between the fully opened and closed positions.

On the upstream side of the front plate is attached a velocity stack assembly for each port. The assembly is comprised of a plurality of upstream stacked spacers or plates. The spacers can be of varying thicknesses to provide adjustability to the flow and velocity characteristics of the air passing through the base housing. Such changes in the stack height permits fine tuning of the engine to accomplish peak torque at specific rpm's. Because of the modular design of the stack assembly, quick changes can be made to add or subtract spacers to each stack from the front of the motor where the air intake usually resides and is readily assessable.

DETAILED DESCRIPTION OF THE PREFERRED EMBODIMENT

While the invention will be described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

Figure 1:
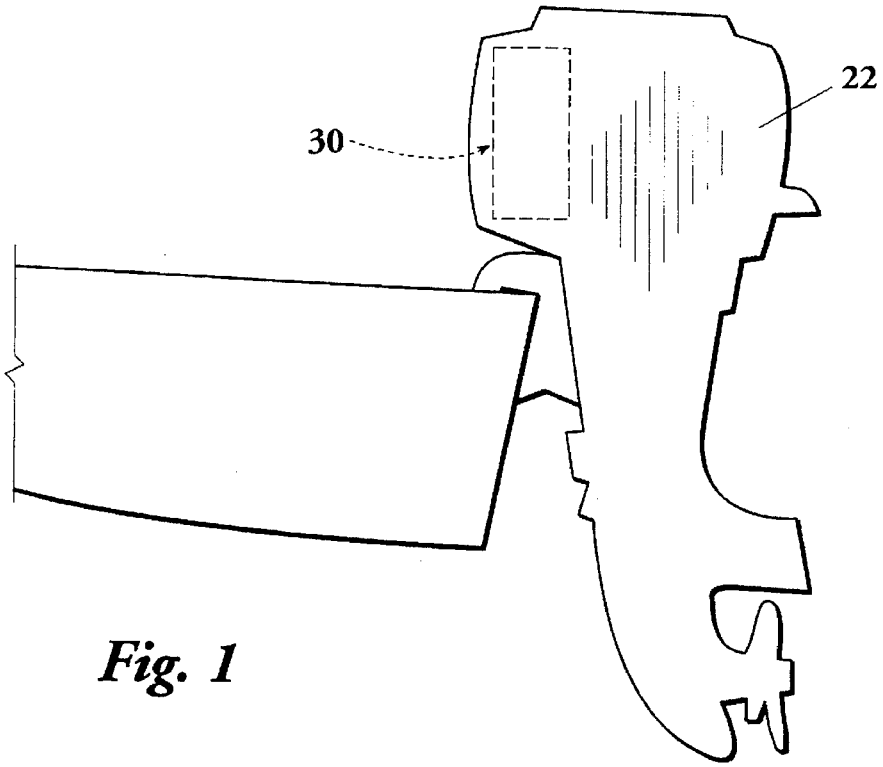
FIG. 1 is a simplified view of an outboard motor and the location of the air throttling assembly of this invention.

Referring to the drawings, and in particular FIG. 1, an air manifold assembly to which this invention is directed is shown partially dotted and generally designated by the numeral 20. Although the invention can have applicability to other forms of internal combustion engines, it has particular applicability to outboard motor engines, preferably two-cycled electronic fuel injected models.

Figure 2:
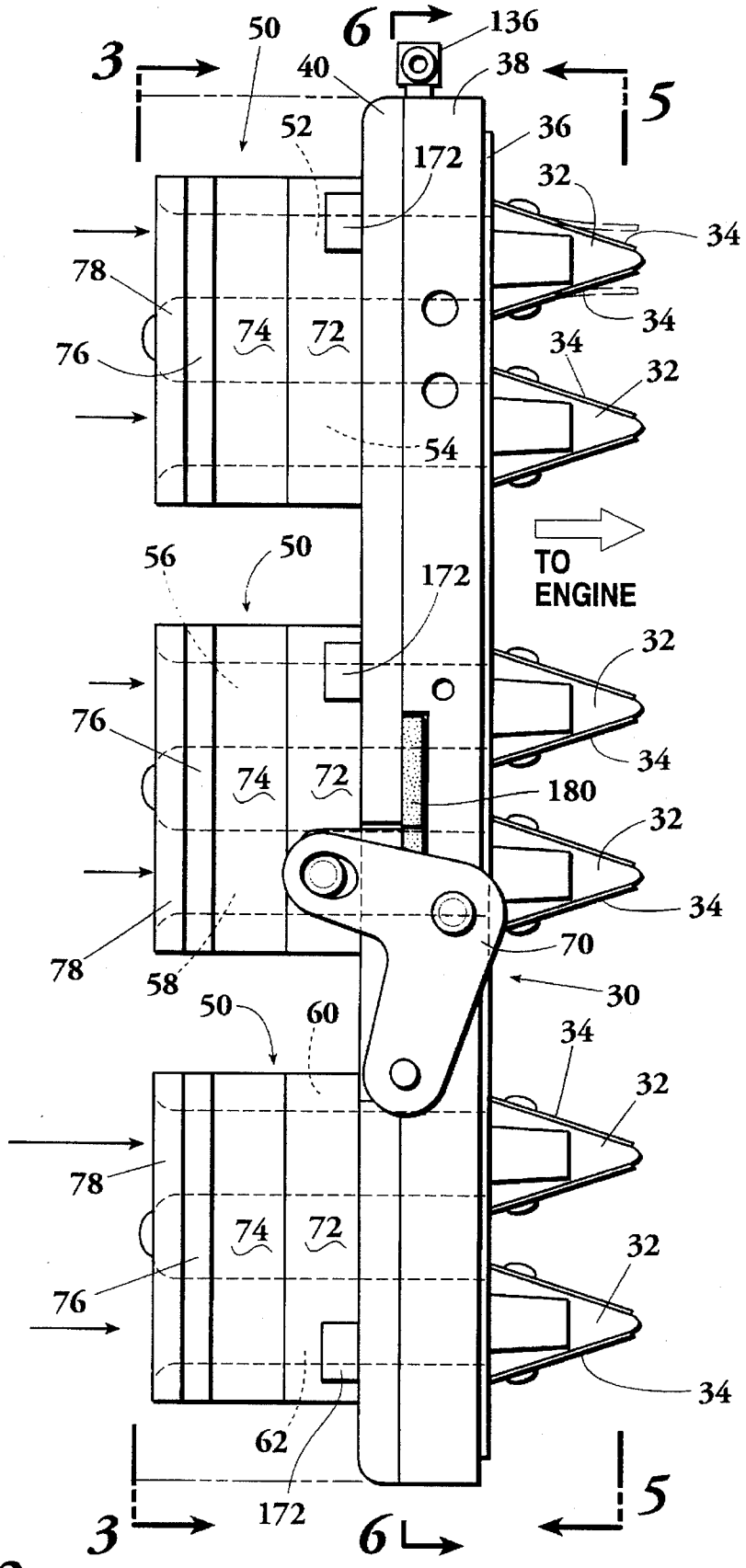
FIG. 2 is an exploded view of the manifold assembly utilizing the concepts of this invention.
Figure 3:
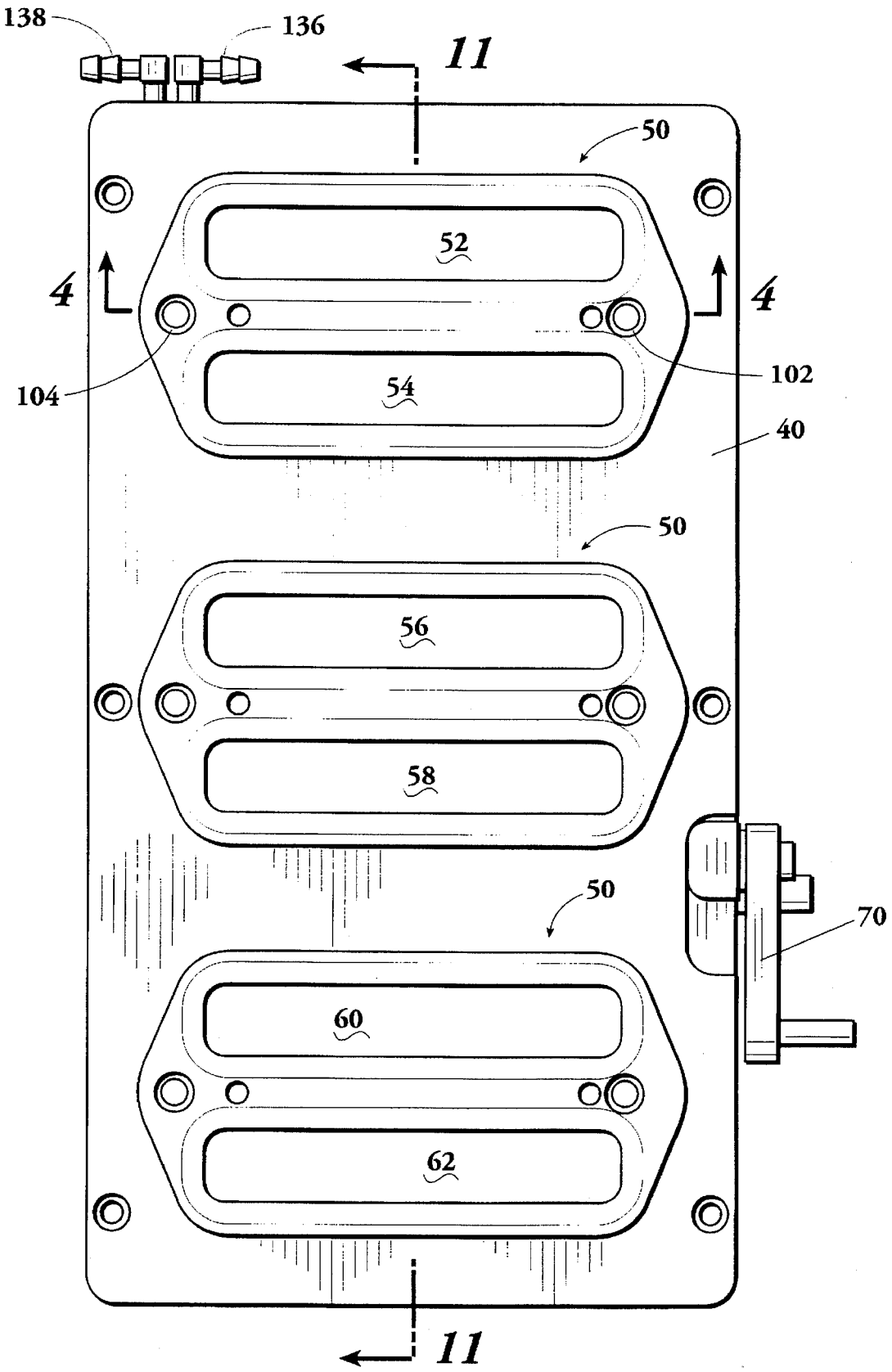
FIG. 3 is a front plan view of the throttle assembly base taken along the line 3—3 of FIG. 2.

Referring to FIG. 2, the assemblage includes the air throttling assembly of this invention which is generally designated by the numeral 30 which will be attached to the engine block, not shown, on the rearward side. The throttling assembly on the rearward or engine side includes openings for each cylinder, the inlet to which is controlled by a bank of reed valve cages 32. As is well known in the art, the reed valve assemblies include a plurality of relatively flexible reed members 34 of a thin metal or fiber that will open, as shown dotted, under vacuum from each cylinder at the appropriate time during the stroke cycle. The throttle assembly 30 is bolted to the engine block and sealed by a gasket 36.

The throttling assembly of this invention is comprised of a base housing formed of a downstream rear plate 38 and upstream forward plate 40. Attached to the forward plate 40 are velocity stack assemblies generally designated by the numeral 50 as hereinafter described. The assembly includes a plurality of spaced transverse ports, one for each cylinder, shown dotted in this view, and designated 52, 54, 56, 58, 60 and 62 for the passage of air therethrough as shown by the arrows. A slidable throttle plate encapsulated within the front and rear plates 38 and 40 is operated by throttle linkage 70, which moves the throttle plate to and between the air openings being fully opened and fully closed.

Figure 4A:
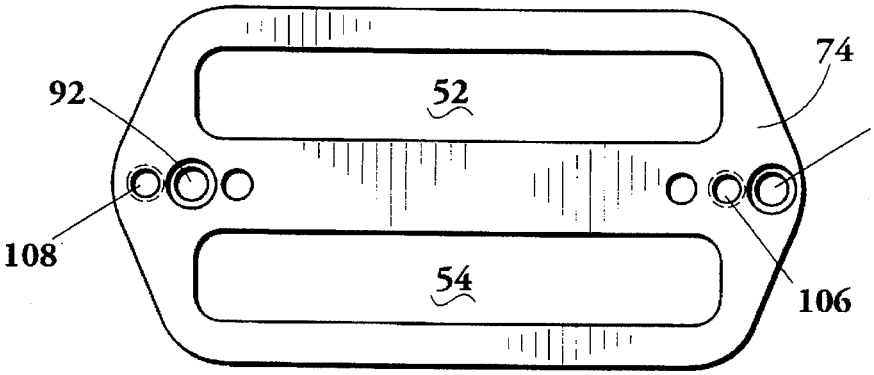
FIGS. 4A and 4B are elevational views taken along the line 4A and 4B of FIG. 4.
Figure 4B:
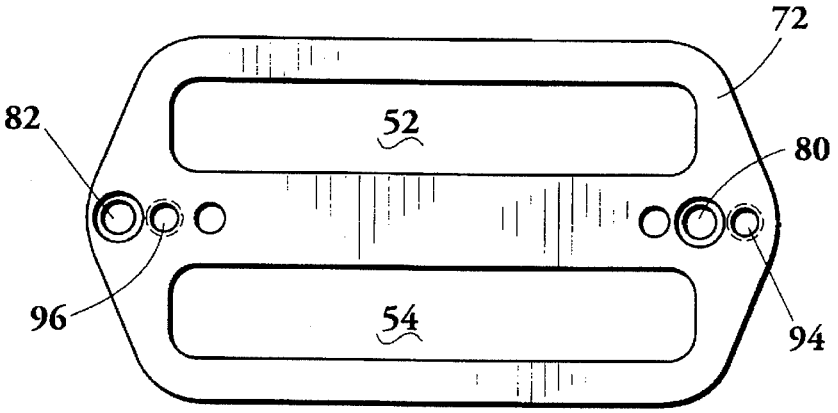
Figure 4:
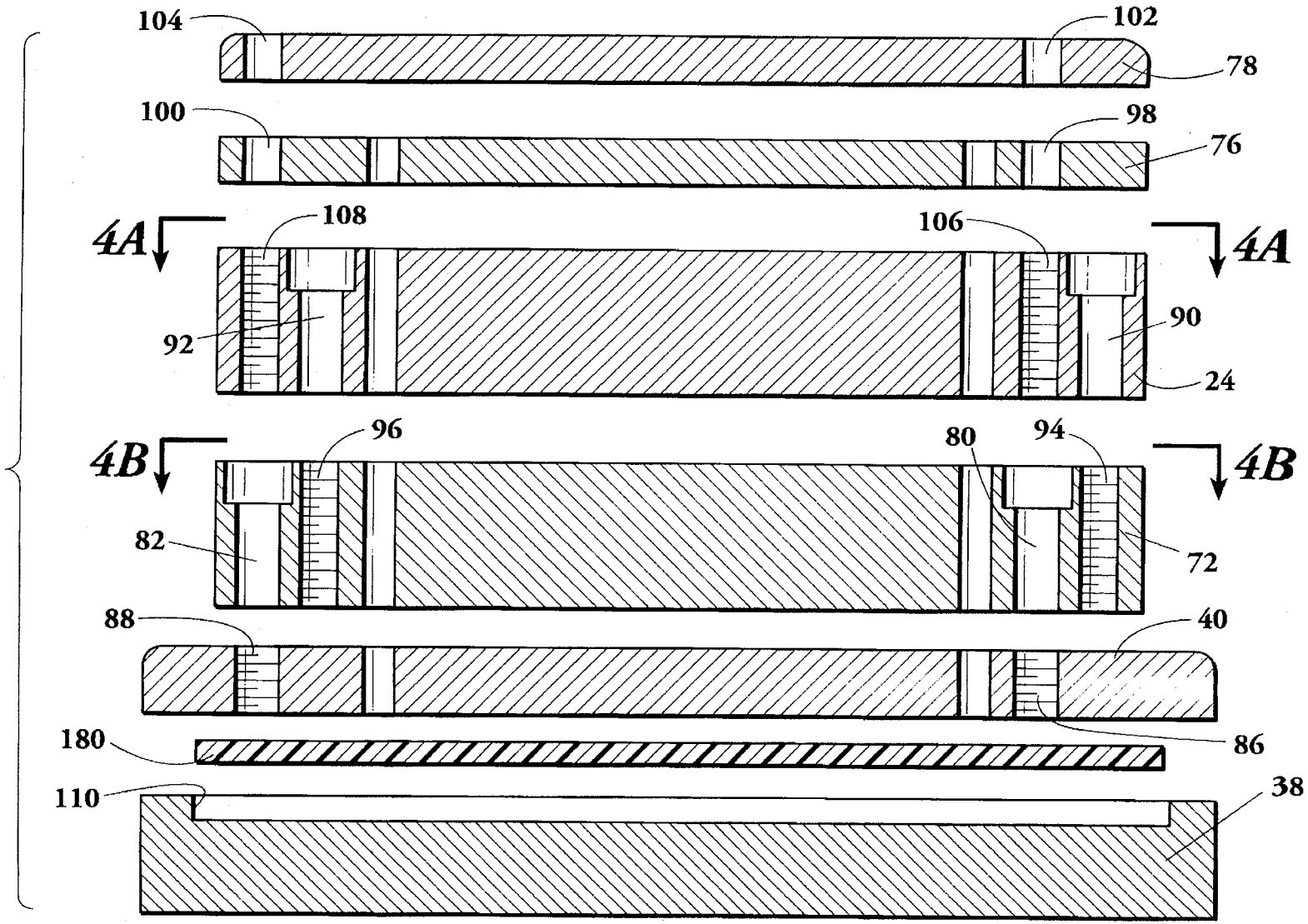
FIG. 4 is an exploded sectional view of one form of velocity stack assembly taken along the line 4—4 of FIG. 3.

FIG. 4, 4A and 4B represent a cross section through a typical velocity stack assembly 50. The velocity stack is comprised of a plurality of stacked spacers 70, 72, 74, 76 and a cap 78, not necessarily in the order shown. The concept of the invention is to be able to build a velocity stack of a variable height utilizing spacers of varying thicknesses. In this particular assemblage, as shown in FIG. 4, spacers 70 and/or 72 will be mounted to the front plate 40 utilizing set screws through openings 80 and 82 into respective threaded openings 86 and 88. If additional spacers are needed, such as 74 and/or 76, which are bolted to each other for easy removal and/or adjustment of the amount of vertical stack. That is, spacer 74 is attached to spacer 72 utilizing threaded bolt openings 90 and 92 which are threaded into spacer 72 through respective offset threaded openings 94 and 96. Likewise, additional spacers 76 and cap 78 are attached to spacer 74 via openings 98 and 100 of spacer 76 and openings 102 and 104 of spacer 78. This attachment method permits adjustment of the stack height without removal of the entire stack assembly. For example, cap 78 can be bolted directly to plate 40 as a minimum spacer height or combined with spacer 76 and bolted to plate 40. Thus, a variety of incremental adjustments can be readily and quickly made that are less than or more than the height shown in FIG. 4 to achieve a desired performance of the engine. In addition, there may be instances where performance characteristics are improved by varying the height of the velocity stacks to each cylinder of a multi-cylinder engine.

Figure 5:
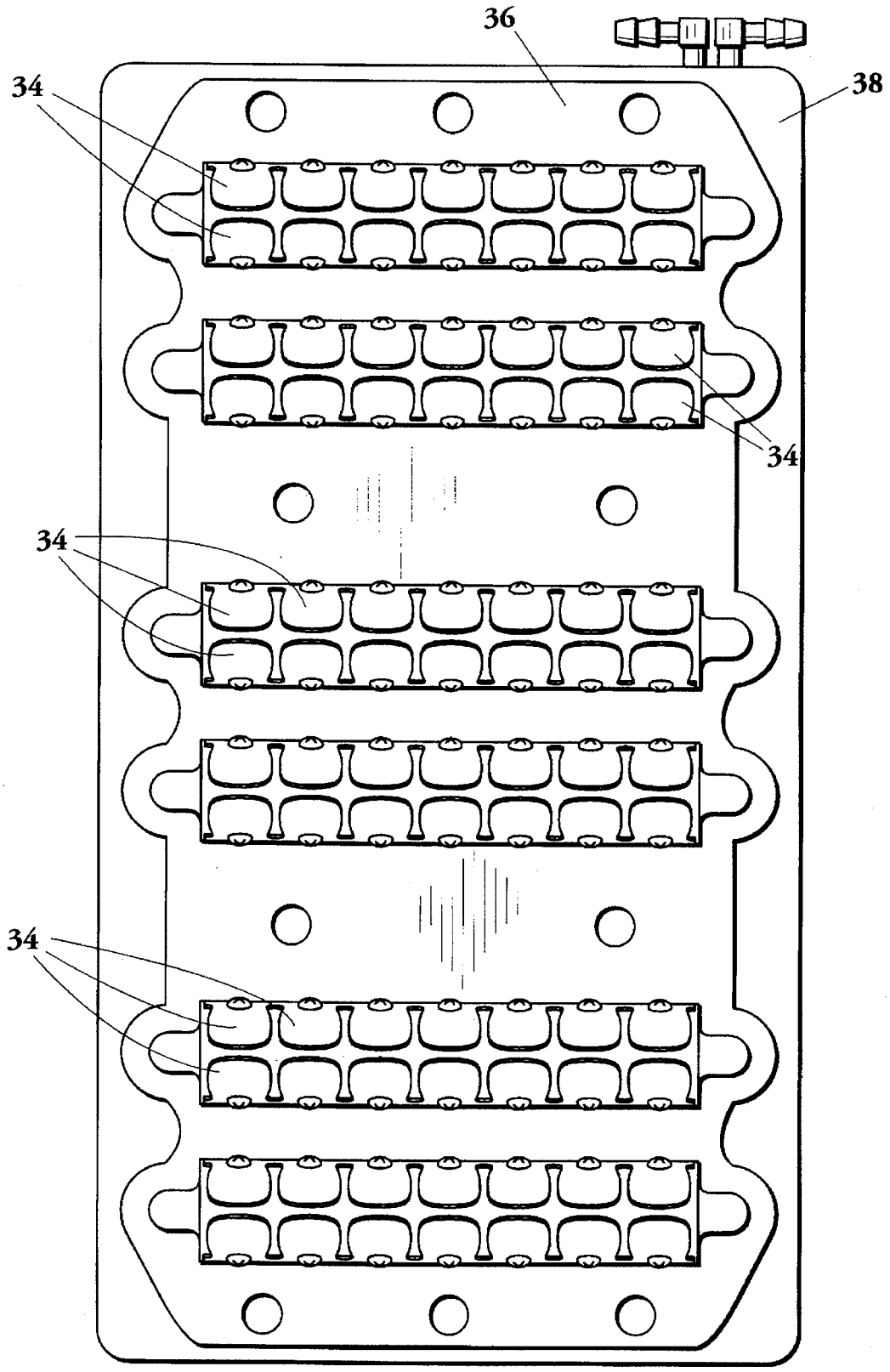
FIG. 5 is a rear elevational view looking from the engine side showing the reed valve cage assembly and taken along the line 5—5 of FIG. 2.
Figure 6:
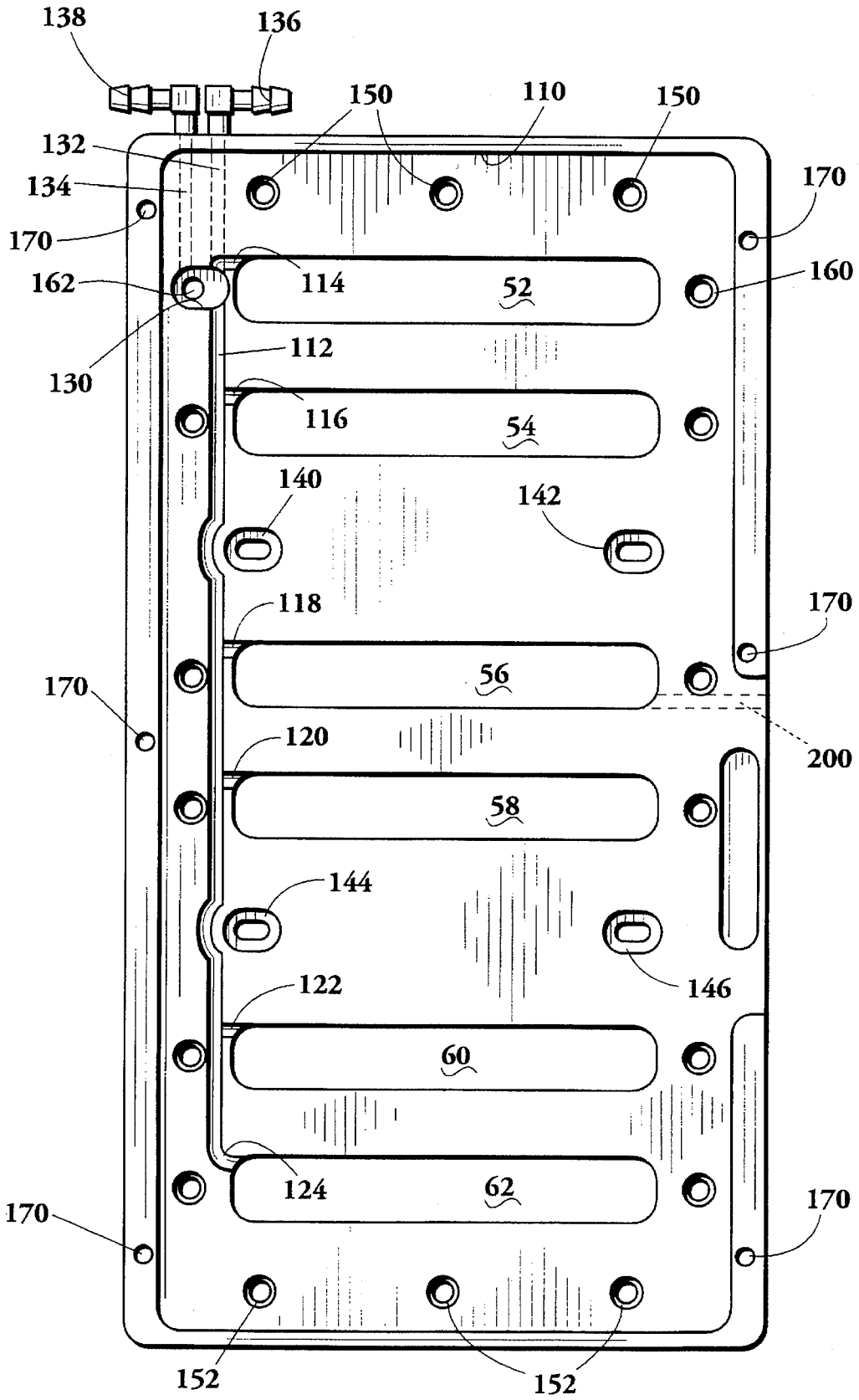
FIG. 6 is an elevational view of the front side of the rear plate of the base housing of this invention.
Figure 8:
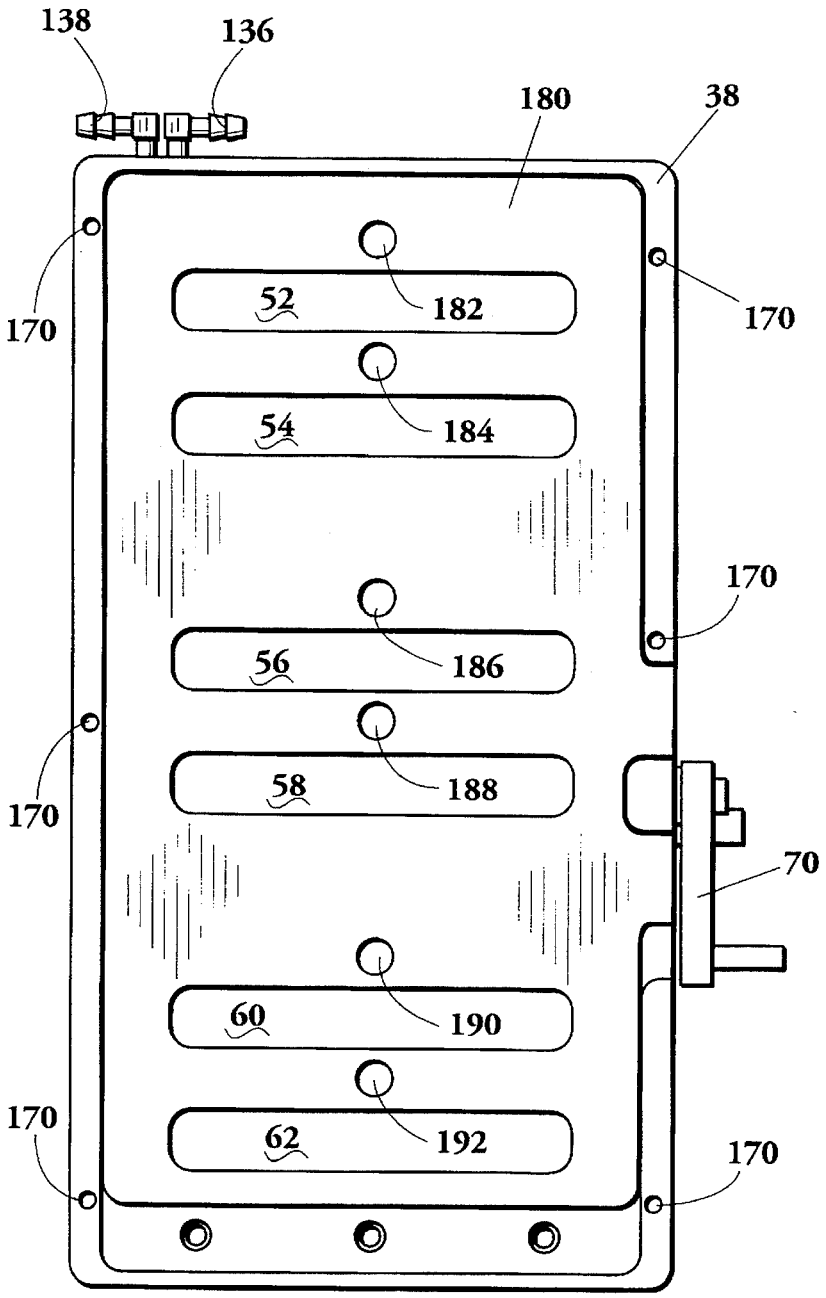
FIG. 8 is a sectional view taken along the line 8—8 of FIG. 7 showing a throttle slide valve in the full open position.

FIG. 6 represents an elevational view of the upstream side of rear plate 38. This side of the plate includes a recessed area formed by peripheral edge 110 to receive slidable throttle plate shown in FIGS. 8 and 10. The plate, of course, includes the air passageways 52, 54, 56, 58, 60 and 62 for the passage of air to each cylinder of the engine. A groove 112 is formed within plate 38 and is in communication with each air passageway 52, 54, 56, 58, 60 and 62 via respective grooves 114, 116, 118, 120, 122, and 124. The groove 112 also communicates with an oval shaped recess 130 which then communicates, via drilled passages 132 and 134, with respective outlet connectors 136 and 138 for use in other vacuum operated functions for the engine. Recessed openings 140, 142, 144, and 146 provide means for attaching the plate 38, including the assembled reed cages as shown in FIG. 5, to the engine block along with upper and lower sets of openings 150 and 152 as further means for fastening the rear plate to the engine housing. Holes 160 and 162 are provided in order to attach the reed cage assembly to the rear side of plate 38. Similar openings are provided for each air passageway 54. 56, 58, 60 and 62 that are not numbered. Once the rear plate and reed valve cage assembly 38 is attached to the engine, the throttling slide valve 180 is positioned within the recess formed by lip 110 and is best shown in FIGS. 7–10. The front plate 40 is then being assembled to the rear plate and held by bolts 172 (see FIG. 2) being attached to peripheral threaded openings 170 around the periphery of the rear plate 38. The slidable throttle plate 180 is shown in FIG. 8 wherein the air passageways 52–62 are fully open whereas in FIG. 10, the slide plate is shown with air passageways fully closed. The throttle plate includes openings 182, 184, 186, 188, 190 and 192 which act as idler bleed orifices which permit restricted air flow to the air passageways 52–62 and has been found to eliminate critical throttle position adjustments when the throttle plate is in the closed position.

Figure 7:
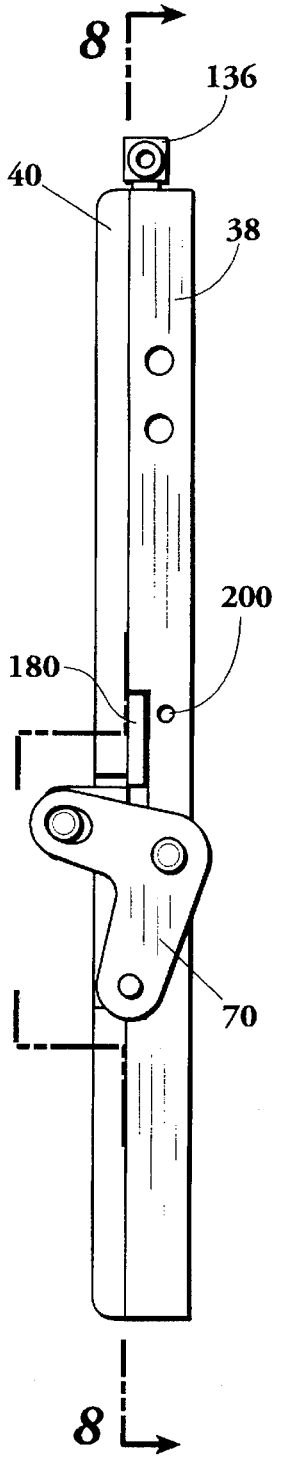
FIG. 7 is a side elevational view of the base housing.
Figure 10:
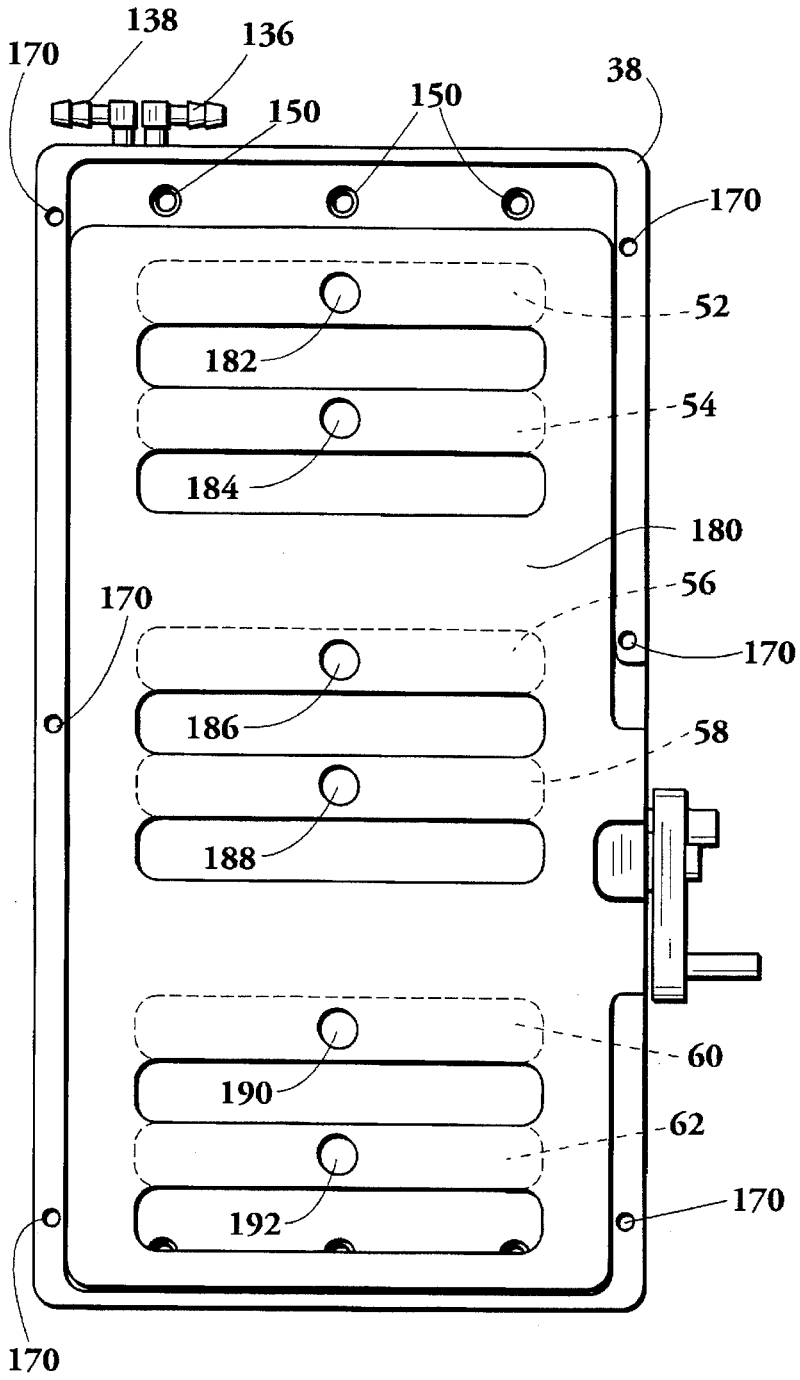
FIG. 10 is a sectional view depicting the slide valve in the fully closed position and taken along the line 10—10 of FIG. 9.
Figure 9:
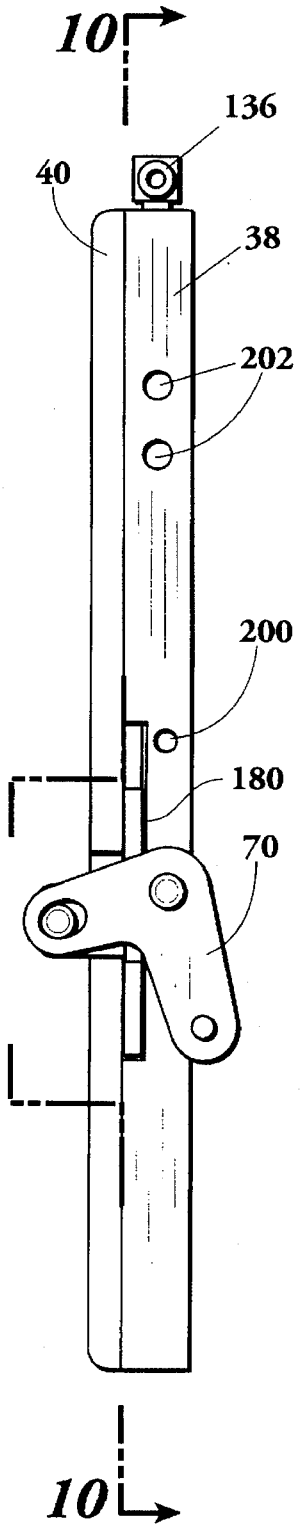
FIG. 9 is a side elevational view of the base housing.

As shown in FIGS. 6, 7 and 9, port 200 intersects air passage 56, which vacuum is used to scavenge accumulated oil from the engine's center main bearing and/or for other purposes. Tapped openings 202 are for the purpose of attaching electronic control systems, fuel regulators, and other instrumentation equipment directly to the rear plate 38. Note that the vacuum grooves 112, 114, 116, 118, 120, 122, and 124 are shrouded and sealed by the throttle plate 180 during less than full throttle openings, and thus, minimizes siphoning and provides greater accuracy in manifold absolute pressure readings. The spacing of the ports in the throttle plate is such that the web therebetween is greater than the width of passageways 52–62 which permits complete closure of the respective air passageways.

Figure 11:
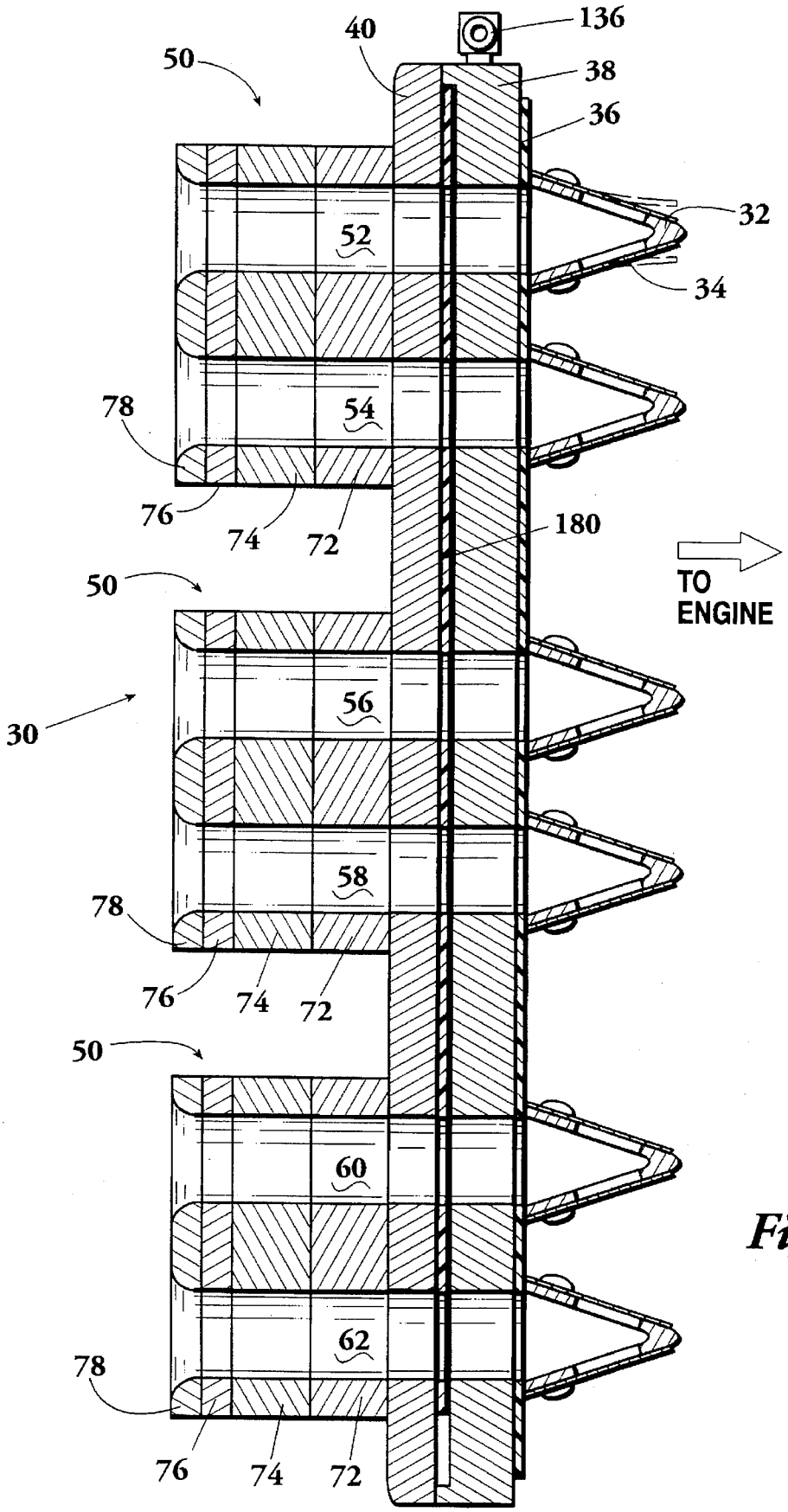
FIG. 11 is a sectional view of the throttle assembly of this invention taken along the line 11—11 of FIG. 3.

The cross sectional view of FIG. 11 provides an additional view of the apparatus of this invention as fully assembled.

The use of the velocity stack, thus, provides a means for fine tuning an engine to create peak torque at specific rpm's, and yet by quickly changing the velocity stacks, which are located conveniently forward of the engine permits quick changes as needed or desired. It is believed that the velocity stacks permit a greater straight line and/or laminar flow characteristic, thus, causing the reed valves to open more efficiently. Although the invention has been described and shown relative to plural cylinder engines, the velocity stack concept of this invention is applicable to any number of cylinders.

What is claimed is:

1. An air throttle assembly for multiple cylinder two-cycle fuel injected engines comprising:

a base housing formed of a connected upstream front plate and a downstream rear plate, said housing having spaced transverse ports, one for each cylinder, for the passage of air downstream to said engine;

means on a downstream side of said rear plate to sealably attach a reed valve cage across each said port;

a vacuum channel formed in an upstream side of said rear plate, said channel in communication with each said port and means, outside said plate, to communicate with said channel;

means to sealably attach said rear plate to said engine;

a slidable throttle plate sealably retained between said front and rear plate having spaced openings to match said transverse ports in one full open position with web sections between said spaced openings to substantially cover said ports in a fully closed position, an idle bleed hole for each port in said web sections, means to slide said throttle plate to and between said open and closed positions;

a velocity stack assembly having an opening fir each said port attached to an upstream side of said front plate, said assembly comprised of at least one upstream stacked spacer.

2. The assembly of claim 1 wherein a plurality of said spacers, each of which is of varying thickness.

3. The assembly of claim 1 wherein a plurality of said spacers, each of which is of uniform thickness.

4. The assembly of claim 1 wherein a plurality of said spacers, each of which is individually connectable to each other and to said upstream side of said front plate.

5. The assembly of claim 4 wherein a first spacer plate is bolted to said front plate, said first spacer having first spaced and threaded openings to receive means to connect with a second spacer having counterbored bolt receiving holes which are alignable with said first spaced and threaded openings of said first spacer, said second spacer having second spaced and threaded openings to receive means to connect with a third spacer having counterbored bolt receiving holes which are alignable with said second spaced and threaded openings of said second spacer.

6. The assembly of claim 5 wherein said spacers are of uniform thickness.

7. The assembly of claim 5 wherein said spacers are of varying thickness.

8. An air throttle and velocity flow control for a plural cylinder two-cycle fuel injected internal combustion engine, comprising:

a base housing assembly connectable to said engine, said assembly formed of a connected upstream front plate and a downstream rear plate, said housing having spaced transverse ports, one for each cylinder for the passage of air downstream to said engine;

means on a downstream side of said rear plate to sealably attach a reed valve cage across each said port;

means to sealably attach said rear plate to said engine;

a slidable throttle plate retained between said front and rear plate having spaced openings to match said transverse: ports in one full open position with sections between said spaced openings to fully cover said ports in a fully closed position, an idle bleed hole for each port in said sections, means to slide said throttle plate to and between said open and closed positions;

a velocity stack assembly having an opening for each said port attached to an upstream side of said front plate, said assembly comprised of at least one upstream stacked spacer.

9. The assembly of claim 8 wherein a plurality of said spacers, each of which is of varying thickness.

10. The assembly of claim 8 wherein a plurality of said spacers, each of which is of uniform thickness.

11. The assembly of claim 8 wherein a plurality of said spacers, each of which is individually connectable to said upstream side of said front plate and to each other.

12. The assembly of claim 11 wherein a first spacer plate is bolted to said front plate, said first spacer having first spaced and threaded openings to receive means to connect with a second spacer having counterbored bolt receiving holes which are alignable with said first spaced and threaded openings of said first spacer, said second spacer having second spaced and threaded openings to receive means to connect with a third spacer having counterbored bolt receiving holes which are alignable with said second spaced and threaded openings of said second spacer.

13. The assembly of claim 12 wherein said spacers are of uniform thickness.

14. The assembly of claim 12 wherein said spacers are of varying thickness.

15. The assembly of claim 8 wherein said engine is a marine outboard motor.

16. An air throttle assembly for multiple cylinder two-cycle fuel injected engines comprising:

a base housing formed of a connected upstream front plate and a downstream rear plate, said housing having spaced transverse ports, one for each cylinder, for the passage of air downstream to said engine;

means on a downstream side of said rear plate to sealably attach a reed valve cage across each said port;

means to receive a vacuum from each port for use outside said base housing;

means to sealably attach said rear plate to said engine;

a slidable throttle plate retained between said front and rear plate having spaced openings to match said transverse ports in one full open position with sections between said spaced openings to fully cover said ports in a fully dosed position, an idle bleed hole for each port in said sections, means to slide said throttle plate to and between said open and closed positions;

means to adjustably change an upstream length of said ports to provide substantially laminar velocity flow to said downstream reed valve cage.

* * * * *